US008192174B2

(12) United States Patent
Süss et al.

(10) Patent No.: US 8,192,174 B2
(45) Date of Patent: Jun. 5, 2012

(54) REFRIGERANT COMPRESSOR HAVING A CONNECTING ROD WITH A FORCE APPLICATION POINT AT CRANK PIN WHICH IS DISPLACED IN A DIRECTION OF THE BEARING IN RELATION TO THE AXIAL CENTER OF THE CRANK PIN

(75) Inventors: Jürgen Süss, Soenderborg (DK); Christian Jepsen, Soenderborg (DK)

(73) Assignee: Danfoss A/S, Nordborg (DK)

( * ) Notice: Subject to any disclaimer, the term of this patent is extended or adjusted under 35 U.S.C. 154(b) by 389 days.

(21) Appl. No.: 12/471,724

(22) Filed: May 26, 2009

(65) Prior Publication Data

US 2010/0092313 A1 Apr. 15, 2010

(30) Foreign Application Priority Data

May 27, 2008 (DE) ..... 10 2008 025 323

(51) Int. Cl.
*F04B 1/04* (2006.01)
*F04B 35/04* (2006.01)
*F04B 17/00* (2006.01)

(52) U.S. Cl. ..... 417/273; 417/415; 417/419; 417/902

(58) Field of Classification Search ..... None
See application file for complete search history.

(56) References Cited

U.S. PATENT DOCUMENTS

| | | | | |
|---|---|---|---|---|
| 4,478,559 | A * | 10/1984 | Andrione et al. | 417/368 |
| 7,631,729 | B2 * | 12/2009 | Tsuchiya et al. | 184/6.5 |
| 7,736,132 | B2 * | 6/2010 | Bliss et al. | 417/273 |

FOREIGN PATENT DOCUMENTS

| | | | |
|---|---|---|---|
| CN | 1566666 | A | 1/2005 |
| DE | 3030319 | A1 | 4/1981 |
| DE | 3544315 | A1 | 7/1986 |
| DE | 3719436 | A1 | 1/1988 |
| GB | 177225 | | 3/1922 |
| GB | 1122348 | | 8/1968 |
| JP | 10122145 | A | 5/1998 |

OTHER PUBLICATIONS

Machine translation of JP1998-122145 A.*
Machine Translation of JP1998-122145 A, published 1998.*

* cited by examiner

*Primary Examiner* — Toan Ton
*Assistant Examiner* — Britt D Hanley
(74) *Attorney, Agent, or Firm* — McCormick, Paulding & Huber LLP

(57) ABSTRACT

The invention concerns a refrigerant compressor (1), in particular a semi-hermetic refrigerant compressor, with a compressor block (5) comprising several cylinders arranged in a star shape, a motor, whose rotor is unrotatably connected to a crankshaft (11) that comprises a crank pin (22) and is supported in a bearing (13) in the compressor block (5), and a piston in each cylinder, each piston being connected via a connecting rod (23) to the crank pin (22), the connecting rod (23) comprising a bearing pad (24) that rests on the crank pin (22), the bearing pads (24) of all connecting rods (23) being held on the crank pin (22) by means of a ring arrangement (25). It is endeavored to keep the load on the crankshaft small. For this purpose, each connecting rod (23) has a power application point (49) at the crank pin (22), which is displaced in the direction of the bearing (13) in relation to the axial center of the crank pin (22).

11 Claims, 2 Drawing Sheets

REFRIGERANT COMPRESSOR HAVING A CONNECTING ROD WITH A FORCE APPLICATION POINT AT CRANK PIN WHICH IS DISPLACED IN A DIRECTION OF THE BEARING IN RELATION TO THE AXIAL CENTER OF THE CRANK PIN

CROSS REFERENCE TO RELATED APPLICATION

Applicant hereby claims foreign priority benefits under U.S.C. §119 from German Patent Application No. 10 2008 025 323.5 filed on May 27, 2008, the contents of which are incorporated by reference herein.

FIELD OF THE INVENTION

The invention concerns a refrigerant compressor, in particular a semi-hermetic refrigerant compressor, with a compressor block comprising several cylinders arranged in a star shape, a motor, whose rotor is unrotatably connected to a crankshaft that comprises a crank pin and is supported in a bearing in the compressor block, and a piston in each cylinder, each piston being connected via a connecting rod to the crank pin, the connecting rod comprising a bearing pad that rests on the crank pin, the bearing pads of all connecting rods being held on the crank pin by means of a ring arrangement.

BACKGROUND OF THE INVENTION

Such a refrigerant compressor is, for example, known from DD 64 769 A. This refrigerant compressor comprises two or three cylinders. In this connection, the bearing pads of the connecting rods are held on the crank pin by means of two rings, one ring being arranged above the connecting rod, one ring being arranged under the connecting rod.

With such an arrangement of the connecting rods, it may be observed during operation that after a certain time a certain wear will appear, which shows in the area of the crankshaft.

SUMMARY OF THE INVENTION

The invention is based on the task of keeping the load on the crankshaft small.

With a refrigerant compressor of the kind mentioned in the introduction, this task is solved in that each connecting rod has a power application point at the crank pin, which is displaced in the direction of the bearing in relation to the axial centre of the crank pin.

This embodiment reduces the axial distance between the bearing of the crankshaft and the power application points of the connecting rods. This results in favourable conditions in relation to a tilting loading of the crankshaft. Accordingly, the load on the crankshaft and its bearings is kept small, so that also the wear can be kept small. As the crankshaft is less tilted or inclined, also the risk that the pistons may cock in the cylinders is also reduced. This reduces the friction of the pistons in the cylinders, which increases the efficiency of the refrigerant compressor. The power application point of a connecting rod is in a first approach to be seen in the extension of the connecting rod in the direction of the crank pin. In a manner of speaking, the force acting back upon the crank pin from the piston during a pressure stroke of the piston is concentrated in the power application point.

Preferably, the ring arrangement has one single ring, which is arranged on the side of the connecting rods facing away from the bearing. The use of one single ring simplifies the assembly. It is no longer necessary to handle two rings at the same time. Further, the assembly is simplified in that the ring can be fitted on the bearing pads from the free end of the crank pin. Here, sufficient room is available for the mounting. The mounting movement of the ring is not hindered by the connecting rod. As the power application point of the connecting rod on the crank pin is displaced in the direction of the bearing of the crankshaft, it is now possible to position the ring in the approximate axial centre of the crank pin, so that also one single ring will provide sufficient stability for the fixing of the bearing pads on the crank pin.

Preferably, the ring has at least one foot, with which it rests on a bearing surface, on which also the bearing pads rest. This permits an axial fixing of the ring in relation to the bearing pads and also in relation to the crank pin.

It is preferred that the bearing surface is formed by an oil pump. The oil pump is required at the lower end of the crankshaft anyway, to supply oil to the areas that have to be lubricated. Now, the oil pump can also be used to support the bearing pads and the ring.

Preferably, the foot is arranged outside the bearing pads in the radial direction. Thus, the bearing pads can move without being hindered by the ring. Nevertheless, the support of the ring by the foot is ensured.

Preferably, at least one bearing pad has at least one bearing surface, which extends in the axial direction symmetrically to the force application point. During a pressure stroke, this means a symmetrical load on the bearing surface and small lateral forces. Thus, it can be prevented that the piston cocks during a pressure stroke. This also contributes to a reduction of the wear.

Preferably, the bearing pad has a second bearing surface, which is separated from the first bearing surface in the axial direction by a circumferential oil channel. The second bearing surface forms a further radial support of the connecting rod, which is particularly effective during a suction stroke of the piston. During a suction stroke of the piston, the forces appearing will attempt to lift the bearing pad from the crank pin. The bearing pad is held to rest on the crank pin by the ring. However, forces will appear which could, under unfavourable conditions, cause a tilting of the bearing pad in relation to the crank pin. This second bearing surface may reduce or even prevent this tilting.

Preferably, the oil channel opens into an axially extending longitudinal channel at the circumference of the crank pin, said channel being arranged in a position, which is below the bearing pad during a suction stroke of a piston. During a suction stroke, the pressure of the bearing pad on the crank pin subsides. Via the longitudinal channel oil can then be supplied over the whole axial extension of the bearing pad into the area between the bearing pad and the crank pin. This provides favourable lubrication conditions. During a subsequent pressure stroke, the bearing pad will rest on the crank pin via an oil film, so that the wear is kept small.

Preferably, the ring covers the oil channel. This results in favourable conditions, with which the ring will exactly act upon the bearing pad during a suction stroke of the piston. The second bearing surface can then in an optimum manner counteract a tilting of the bearing pad in relation to the crank pin.

Preferably, each bearing pad has an extension in the axial and circumferential directions, which is smaller that a cross-sectional surface of the cylinder allocated to the bearing pad. Such an embodiment is favourable for the assembly of the refrigerant compressor. The piston with the connecting rod and the bearing pad can be inserted through the cylinder and be pushed radially inwards until the bearing pad comes to rest on the crank pin. In this connection, the bearing pad fits into the internal width provided by the cylinder. As soon as the bearing pads of all pistons rest on the crank pin, the ring can be mounted.

Preferably, all connecting rods have the same embodiment. This simplifies the assembly and the stock handling. It is no longer required to make sure that different bearing pads or connecting rods are used for different pistons.

BRIEF DESCRIPTION OF THE DRAWINGS

In the following, the invention is described on the basis of a preferred embodiment in connection with the drawings, showing.

DETAILED DESCRIPTION OF THE PREFERRED EMBODIMENTS

Figure 1:
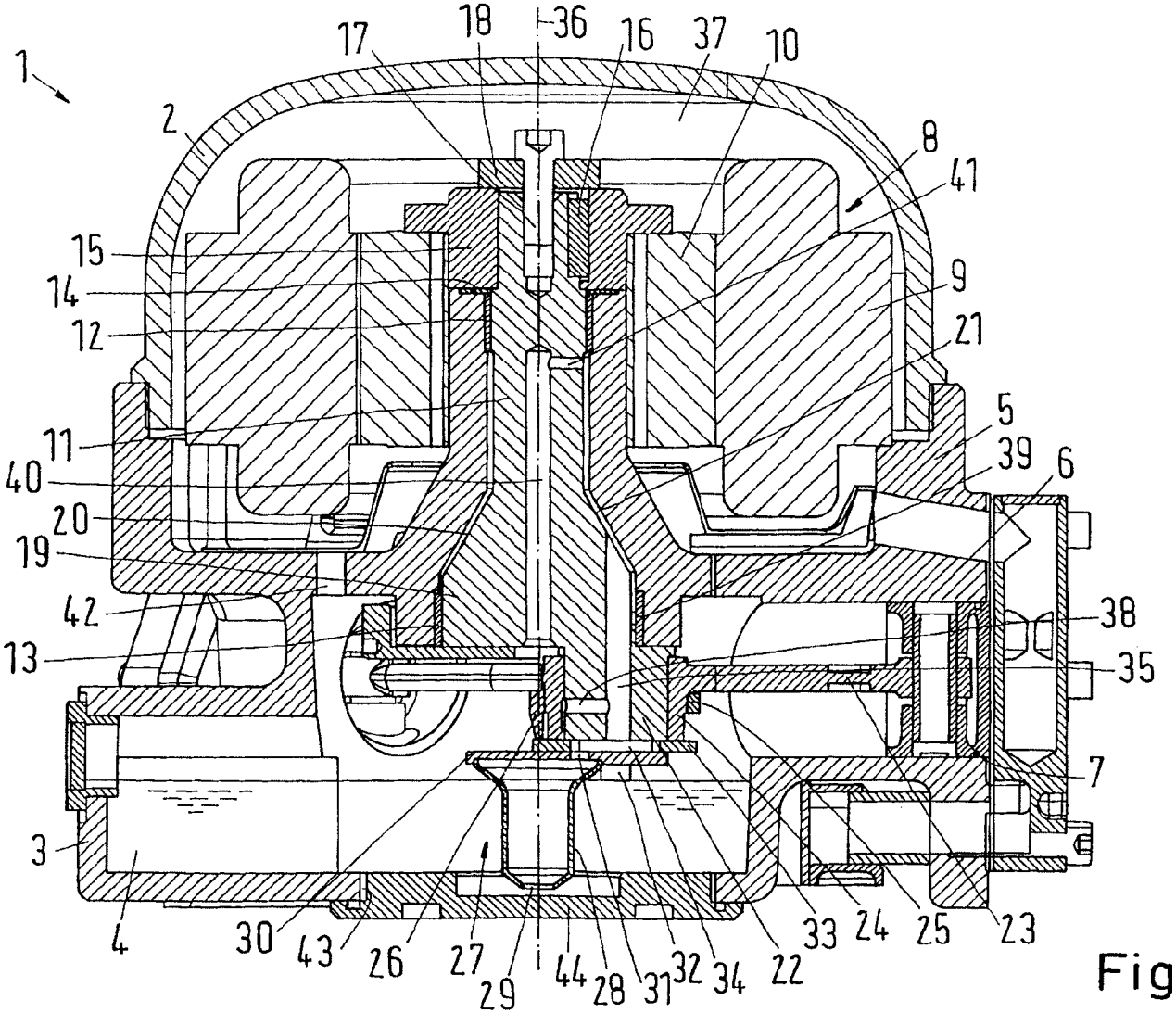
FIG. 1 is a cross-sectional view of a semi-hermetic refrigerant compressor.

FIG. 1 shows a semi-hermetic refrigerant compressor 1 with a housing 2, whose bottom part 3 comprises an oil sump 4. The compressor 1 has a compressor block 5, in which several, in the present case three cylinders 6 are arranged in a star shape and symmetrically, that is, in the circumferential direction the central axes of the cylinders 6 have a distance of 120°. A piston 7 is arranged in each cylinder 6.

It is shown that the bottom part 3 of the housing 2 is made in one piece with the compressor block 5. This is advantageous, but not absolutely necessary. The bottom part 3 and the compressor block 5 can also be subdivided. Compressor block 5 and bottom part 3 can be made as castings.

Further, the compressor 1 has an electric motor 8, whose stator 9 is connected to the compressor block 5 in a manner not shown in detail. Further, the motor 8 has a rotor 10. The motor 8 can be made as a permanent-magnet activated synchronous motor, whose rotor can comprise permanent magnets, not shown in detail.

A crankshaft 11 is rotatably supported in the compressor block 5. In this connection, the support occurs via a first radial bearing 12 at the upper end of the crankshaft, a second radial bearing 13 at the lower end of the crankshaft 11 and an axial bearing 14, also at the upper end of the crankshaft 11.

A bearing element 15 rests on the axial bearing 14, said bearing element 15 being unrotatably connected to the crankshaft 11 via a spring 16. By means of a screw 17, the crankshaft 11 is held against a support plate 18, which rests on the top of the bearing element 15 in the gravity direction. Thus, the crankshaft 11 is positioned in relation to the compressor block 5 in the axial direction.

At its lower end, the crankshaft 11 has a diameter extension 19. The diameter extension 19 extends via a conical area 20, located between the two radial bearings 12, 13, into the remaining area of the crankshaft 11. Between the two radial bearings 12, 13, the compressor block 5 surrounds the crankshaft 11 with a small distance, so that here an oil pressure chamber 21 is formed.

At its lower end, the crankshaft 11 has a crank pin 22. Each piston 7 is connected to the crank pin 22 via a connecting rod 23. Each connecting rod 13 has a bearing pad 24, which rests on the circumference of the crank pin 22. The bearing pads 24 are held on the crank pin 22 by means of a ring 25. In this connection, the connecting rod 23 is displaced in relation to the axial centre of the crank pin 22 in the direction of the radial bearing 13, for short also called "main bearing". The ring 25 is arranged on the side of the connecting rod 23 facing away from the main bearing 13. The ring 25 is provided with several feet 26, which extend in the axial direction exactly as far down as the bearing pads 24.

An oil pump arrangement 27 is fixed at the lower end of the crank pin 22. The oil pump arrangement 27 has a first supply element 28 that is submerged in the oil sump 4 and has an opening 29 at its lower end, through which oil can enter the inside of the first supply element 28. As can be seen from the drawing, the lower end of the first supply element has a smaller diameter than the upper end. Accordingly, when the first supply element 28 rotates, oil that is available inside the first supply element will be transported upwards by the centrifugal force.

The upper side of the first supply element 28 is covered by a cover 30 in the form of a plate. In an area below the crank pin, the cover 30 has an opening 31. Otherwise, the cover 30 extends so far over the front side of the crank pin 22 that the first supply element 28, which is, for example, locked, welded or glued to the cover 30, can be fixed on the crank pin 22 by means of the cover 30. For this purpose, the cover element 30 is connected to the crank pin 22 by means of screws 32, which are screwed into the front side of the crank pin 22.

A second supply element 33 having a radially extending slot 34 is arranged between the cover element 30 and the crank pin 22.

An oil supply channel 35 extends through the diameter extension 19, eccentrically to the crankshaft axis 36. In other words, the oil supply channel 35 has a relatively large distance to the crankshaft axis 36 in the radial direction. The slot 34 in the second supply element 33 extends from the opening 31 in the cover element 30 to the oil supply channel 35. Oil reaching the slot 34 from the first supply element 28 and the opening 31 is therefore pressed into the oil supply channel 35 with a relatively high pressure, the oil supply channel 35 being connected to the oil pressure chamber 21. Of course, the oil pressure also depends on the speed of the crankshaft 11.

The oil pressure chamber 21 is closed, except for a vent path, through which, however, only relatively little oil, if any at all, can escape. Accordingly, a relatively large oil pressure can be built up in the oil channel 35 and also in the oil pressure chamber 21, said pressure ensuring that the radial bearings 12, 13 and the axial bearing 14 can be sufficiently lubricated. An escape of oil to the environment is practically non-existent. Accordingly, the risk is small that the escaping oil mixes with refrigerant gas that flows in the inner chamber 37 of the housing 2.

A first radial channel 38 starts from the oil supply channel 35, said radial channel 38 ending in the circumferential surface of the crank pin 22, supplying this circumferential surface of the crank pin 22 with oil under a certain pressure, so that the contact points between the crank pin 22 and the bearing pads 24 are lubricated. A second radial channel 39 ends in the area of the main bearing 13, so that the main bearing 13 is not only lubricated by oil from the oil pressure chamber 21, but also directly from the oil supply channel 35. Alternatively, other cuttings can be made to generate oil channels.

The crankshaft 11 has in its axial centre a gas channel 40, which ends in the inner chamber 37 of the housing at the lower front side of the crankshaft 11. In this connection, the crank pin 22 is arranged so that it leaves the opening of the gas channel 40 completely free. The gas channel 40 is connected to the oil pressure chamber 21 via a radial bore 41.

In a manner not shown in detail, a small groove is provided in the first radial bearing 12 and in the axial bearing 14, respectively, through which grooves the oil from the oil pressure chamber can flow. The cross-section of these grooves is, however, relatively small, so that these grooves provide a substantial resistance against the oil. These grooves may be provided additionally or alternatively to the gas channel 40. Additionally to or instead of the grooves, also millings of the crankshaft can be used to generate one or more flattenings, which can then be used as vent channel.

At operation begin; usually the oil channel 35 and the oil pressure chamber 21 do not contain oil, but gas, for example refrigerant gas. Also during operation, it may happen that refrigerant gas degasses from the oil, so that gas bubbles occur in the oil, which may have a negative influence on the lubrication properties of the oil. The oil displaces these oil bubbles into the radial bore 41, and the oil bubbles can then flow off through the gas channel 40 into the inner chamber 37. However, oil cannot flow off through the radial bore 41, as the centrifugal force acting upon the oil during a rotation of the crank shaft 11 cannot press the oil inwards. Accordingly, together with the radial bore 41, the gas channel 40 forms a vent path, through which practically no oil can escape from the oil pressure chamber 21 into the environment.

Also with the alternative embodiment of the vent path with the grooves in the first radial bearing 12 and in the axial bearing 14, practically no oil can escape in an uncontrolled manner from the oil pressure chamber 21 into the environment. Firstly, as mentioned, the cross-section of the grooves is so small that they provide a substantial resistance against the oil. Secondly, the oil would practically have to perform a right-angled directional change, which would also contribute to an increase of the flow resistance. For refrigerant gas that gathers in the oil pressure chamber 21, this flow resistance is, however, smaller, so that the refrigerant gas can easily escape through this kind of vent path. If oil should also escape through this vent path, it would reach the inside of the rotor 10, from where it can flow to the upper side of the compressor block 5 and then escape through oil openings 42 into the oil sump 4.

The lower part 3 of the housing 2 has a mounting opening 43, which is closed by a closing element 44. The closing element 44 is screwed into the bottom part 3. The size of the mounting opening 43 is so that the crankshaft 11 with the diameter extension 19 and crank pin 22 can be inserted in the compressor block 5 from the bottom part 3. In this connection, the closing element 44 is screwed into the mounting opening 43.

Figure 2:
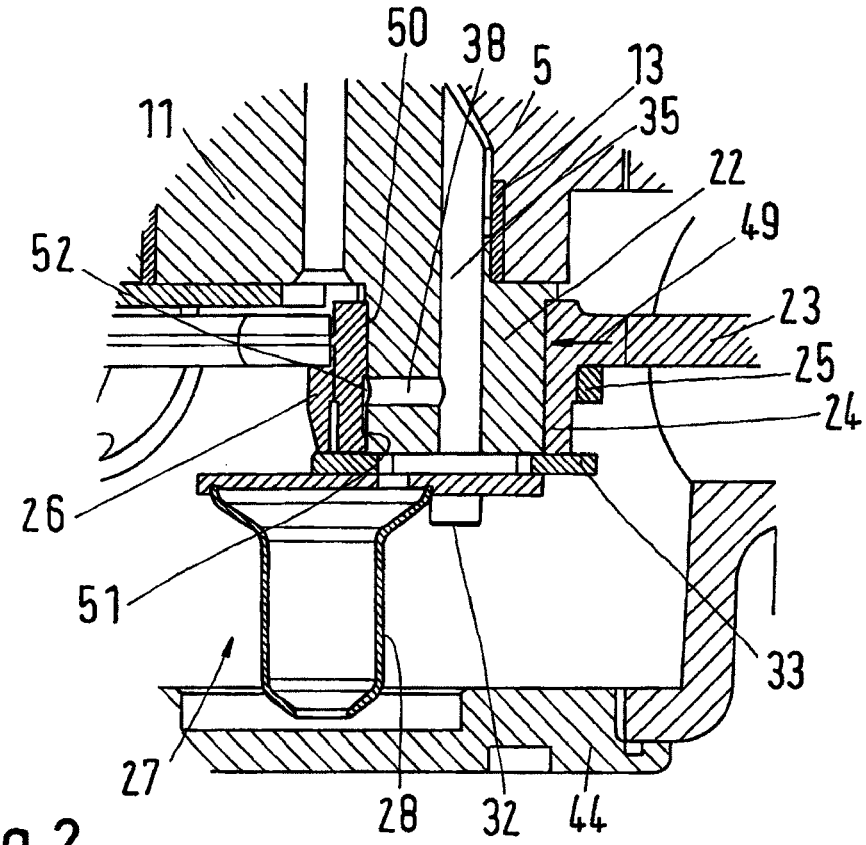
FIG. 2 is an enlarged view of the crank pin.
Figure 3:
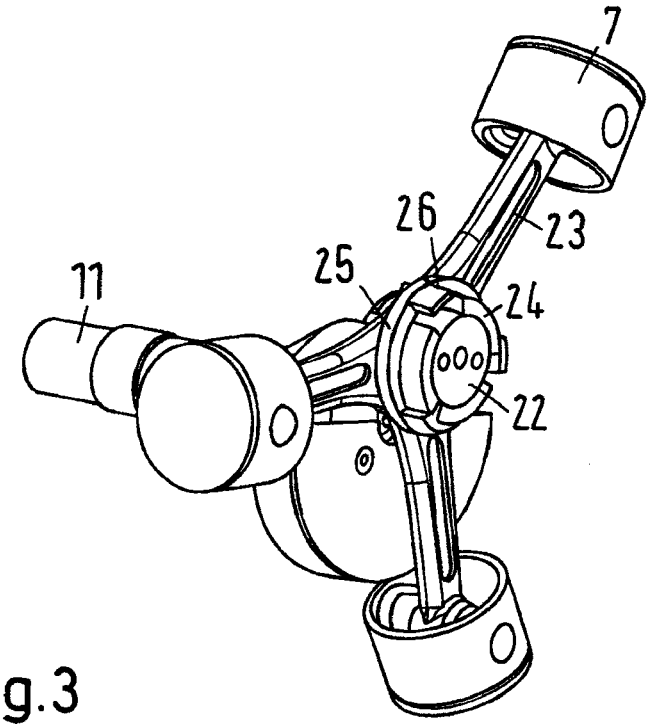
FIG. 3 is a perspective view of the crankshaft with three pistons.

In the FIGS. 2 and 3 same elements as in FIG. 1 are provided with the same reference numbers.

FIG. 2 shows an enlarged view of the crank pin 23 with the mounted bearing pads 24, which are held to rest on the crank pin 22 by the ring 25.

A force application point 49 is symbolized by an arrow. It can be seen that the force application point 49 does not act on the axial centre of the crank pin 22, but is displaced in relation to the axial centre in the direction of the radial bearing 13. This gives a smaller lever, with which the force during a pressure stroke of the piston 7 can act back upon the crank pin 22 via the connection rod 23.

The bearing pad has a first bearing surface 50, which extends axially on both sides of the force application point 49 and which is axially located substantially symmetrically to the force application point 49. Thus, during a pressure stroke of the piston 7, the first bearing surface 50 is symmetrically loaded, so that it may be assumed that during a pressure stroke the bearing pad 24 is not tilted in relation to the crank pin 22.

The bearing pad 24 also has a second bearing surface 51, which is separated from the first bearing surface 50 by an oil channel 52. The oil channel 52 is made as a circumferential groove. It is connected via the first radial channel 38 to the oil supply channel 5; so that the oil channel 52 is always supplied with sufficient oil under pressure to lubricate the contact area between the bearing pad 24 and the crank pin 22.

Further, the crankshaft 11 is connected to a balance weight (FIG. 3).

In a manner not shown in detail, the oil channel 52 is connected to an axially extending groove at the circumference of the crank pin 22. This groove is located so that it lies under a bearing pad 24, when the related piston 7 performs a suction stroke. During a suction stroke, the pressure load between the bearing pad 24 and the crank pin 22 subsides, so that in this situation oil can immediately enter the gap between the bearing pad 24 and the crank pin 22.

The ring 25 covers the oil channel 52, that is, it lies at the contact point between the first bearing surface 50 and the second bearing point 51. During a suction stroke, a pulling force acts via the connecting rod 23 upon the bearing pad 24. The ring 25 then forms a "turning point", via which the second bearing surface 51 rests on the crank pin 22. The bearing pad 24 can then, due to the relatively long lever arm of the second bearing surface 51, rest on the crank pin 22 in such a manner that it does practically not tilt. This contributes to preventing a cocking of the piston 7 in the cylinder 6, which again keeps the wear small.

As can be seen from FIG. 2, both the bearing pads 24 and the foot 26 stand on the second supply element 33 of the oil pump arrangement 27. The second supply element 33 is made as a plate, which forms a plane bearing surface. Accordingly, neither the bearing pads 24, nor the feet 26 can slide axially downwards. Accordingly, the position of the bearing pads 24 and the ring 25 on the crank pin 22 are secured.

As can also be seen from FIG. 2, the feet 26 are located outside the bearing pads 24, so that a relative movement in the circumferential direction between the bearing pads 24, the crank pin 22 and the ring 25 remains possible. This movement is not hindered by the feet 26.

In the axial and circumferential directions (in relation to the orientation at the crank pin 22), the bearing pads 24 have an extension, which is dimensioned so that the bearing pads 24 can still be guided through the cylinder 6, when the pistons are mounted. First, the crankshaft 11 can be inserted through the mounting opening 43 in the compressor block 5, and then the pistons 7 with their connecting rods 23 and the bearing pads 24 can be displaced from the outside, until the bearing pads 24 come to rest on the crank pin 22. Then, it is not problem to push the ring 25 with the feet 26 onto the bearing pads 24 and then to fix the oil pump arrangement 27 at the crank pin 22 by means of the screws 32. Thus, the bearing pads 24 are mounted on the crank pin 22.

While the present invention has been illustrated and described with respect to a particular embodiment thereof, it should be appreciated by those of ordinary skill in the art that various modifications to this invention may be made without departing from the spirit and scope of the present invention.

The invention claimed is:

1. A refrigerant compressor, in particular a semi-hermetic refrigerant compressor, with a compressor block comprising several cylinders arranged in a star shape, a motor, whose rotor is unrotatably connected to a crankshaft that comprises a crank pin and is supported in a bearing in the compressor block, and a piston in each cylinder, each piston being connected via a connecting rod to the crank pin, the connecting rod comprising a bearing pad that rests on the crank pin, the bearing pads of all connecting rods being held on the crank pin by means of a ring arrangement, wherein each connecting rod has a force application point at the crank pin, which is displaced in the direction of the bearing in relation to the axial centre of the crank pin.

2. The refrigerant compressor according to claim 1, wherein the ring arrangement has one single ring, which is arranged on the side of the connecting rods facing away from the bearing.

3. The refrigerant compressor according to claim 2, wherein the ring has at least one foot, with which it rests on a bearing surface, on which also the bearing pads rest.

4. The refrigerant compressor according to claim 3, wherein the bearing surface is formed by an oil pump.

5. The refrigerant compressor according to claim 3, wherein the foot is arranged outside the bearing pads in the radial direction.

6. The refrigerant compressor according to claim 1, wherein at least one bearing pad has at least one bearing surface, which extends in the axial direction symmetrically to the force application point.

7. The refrigerant compressor according to claim 6, wherein the bearing pad has a second bearing surface, which is separated from the first bearing surface in the axial direction by a circumferential oil channel.

8. The refrigerant compressor according to claim 7, wherein the oil channel opens into an axially extending longitudinal channel at the circumference of the crank pin, said longitudinal channel being arranged in a position, which is below the bearing pad during a suction stroke of a piston.

9. The refrigerant compressor according to claim 7, wherein the ring covers the oil channel.

10. The refrigerant compressor according to claim 1, wherein each bearing pad has an extension in the axial and circumferential directions, which is smaller that a cross-sectional surface of the cylinder allocated to the bearing pad.

11. The refrigerant compressor according to claim 1, wherein all connecting rods have the same embodiment.

* * * * *